US007999693B2

(12) United States Patent
Höhler

(10) Patent No.: US 7,999,693 B2
(45) Date of Patent: Aug. 16, 2011

(54) WARNING LIGHT FOR OPTICALLY DISPLAYING AT LEAST ONE OPERATING STATE

(75) Inventor: Christian Höhler, Bad Duerrheim (DE)

(73) Assignee: WERMA Holding GmbH + Co. KG, Rietheim-Weilheim (DE)

( * ) Notice: Subject to any disclaimer, the term of this patent is extended or adjusted under 35 U.S.C. 154(b) by 364 days.

(21) Appl. No.: 12/289,581

(22) Filed: Oct. 30, 2008

(65) Prior Publication Data

US 2010/0109897 A1 May 6, 2010

(30) Foreign Application Priority Data

Oct. 31, 2007 (DE) ..... 10 2007 052 377

(51) Int. Cl.
*G08B 5/00* (2006.01)

(52) U.S. Cl. ..... 340/815.4; 340/915; 340/907

(58) Field of Classification Search ..... 340/815.4, 340/815.45, 907, 908, 825.23, 815.5, 815.65–815.66, 340/915
See application file for complete search history.

(56) References Cited

U.S. PATENT DOCUMENTS 4,464,609 A * 8/1984 Nakamura et al. ..... 315/241 P
5,148,212 A * 9/1992 Serikawa et al. ..... 396/61
5,265,468 A * 11/1993 Holst et al. ..... 73/115.01
5,598,242 A * 1/1997 Omi et al. ..... 396/55
6,590,502 B1 * 7/2003 Pederson ..... 340/815.4
7,668,556 B2 * 2/2010 Yokoshi et al. ..... 455/456.3
2006/0274542 A1 12/2006 Goulet

FOREIGN PATENT DOCUMENTS

DE 100 55 297 A1 11/2000
DE 10 2005 059 492 A1 12/2005
DE 10 2006 015 175 A1 3/2006
EP 0 450 426 A1 3/1991
EP 0 450 426 A1 10/1991

* cited by examiner

*Primary Examiner* — Daniel Previl
(74) *Attorney, Agent, or Firm* — Breneman & Georges

(57) ABSTRACT

A warning light is provided for optically displaying at least one and preferably a number of different operating states, of a technical device such as a machine, an installation, a vehicle or the like. The warning light has at least one luminous element for emitting a sequence of illumination pulses within a specific time interval for the display of a specific operating state, in which the illumination characteristic of the illumination pulses are determined by at least one illumination parameter (P) such as brightness, illumination duration, frequency, color, direction of emission or the like to substantially improve perception of the optical display especially for a particularly critical operating state. This is achieved according to the invention by providing an aperiodic change in at least one of the illumination parameters (P) in a specific time interval.

18 Claims, 3 Drawing Sheets

WARNING LIGHT FOR OPTICALLY DISPLAYING AT LEAST ONE OPERATING STATE

BACKGROUND OF THE INVENTION (1) Field of the Invention

The invention relates to a warning light for displaying at least one and preferably a number of different operating states of a technical device such as a machine, an installation, a vehicle or the like, having at least one luminous element for emitting a sequence of a number of illumination pulses within a specific time interval during the display of the specific operating state in which the illumination characteristic of the illumination pulses are determined by at least one illuminated parameter (P) such as brightness, illumination duration, frequency, color, direction of emission or the like.

(2) Description of Related Art Including Information Disclosed Under 37 C.F.R. 1.97 And 1.98

Warning lights, such as signaling columns or the like, for example, are at present already in use in a wide range of variants for signaling and/or displaying operating states on technical devices such as machines, installations or vehicles. They serve chiefly the purpose of signaling, in particular optically and/or acoustically, a malfunctioning of machines or installations, such that the operator is capable of detecting the same and eliminating it. To this end, these lights generally emit the warning, or display the respective operating state in the form of (colored) light and/or an acoustic signal. For example, there is provided for an operating state a display with green light, the aim being to signal that all is in order. To signal a critical operating state, use is frequently made of a display by means of red light, the aim being, for example, to signal that a fault is present, and/or that an area is not to be entered. Precisely in the case of faults or even dangerous states, it is very important that the operators actually do perceive the appropriate signals.

In order to enhance perception in the case of optical signaling devices the following measures have already been used so far: The critical operating state is generated by an increased brightness or by allround light such as, for example, a so-called spinning mirror light etc., or is signaled by a blinking light or by a flashing light.

For example, DE 10 2006 015 175 A1 exhibits a flashing light warning light, the light flash beam generated by means of LED. A flash of light is of a particularly short term and very bright illumination pulse which is separated by dark phases from a subsequent light flash or illumination pulses. Such blinking lights, flashing lights or allround lights alternate between bright and dark phases approximately once per second. In the process, a sequence of a number of illumination pulses is generated for the respective operating state to be displayed.

However, it has been shown in practice that even such measures are not sufficient to enhance perception, above all particularly of critical operating states since numerous different optical impressions act on the operators, for example in large workshops. For example, a number of machines with signaling columns are present, vehicles such as forklift trucks in large workshops, for example, also have flicking lights for indicating driving direction, and/or light pulses are generated during welding and are distributed in a workshop by reflections.

BRIEF SUMMARY OF THE INVENTION

By contrast, it is an object of the invention to provide a warning light for optically displaying at least one operating state, the illumination characteristic of the illumination pulses being determined by at least one illumination parameter such as brightness, illumination duration, frequency, color, direction of emission or the like, and perception of the optical display of the specific operating state, especially a particularly critical operating state, being substantially improved.

This object is achieved, starting from a warning light of the type mentioned in the introduction, by providing an aperiodic change in at least one of the illumination parameters (P) in a specific time period where illumination parameter (P) is brightness, illumination duration, frequency color, direction of emission or the like. Advantageous designs and developments of the invention are achieved by having at least two illumination phases separated by a dark phase, by having at least one dark parameter, by having an aperiodic change in the dark parameter provided in the specific time interval, by having at least two illumination parameters overlap, by having the form of one of the illumination pulses aperiodically changing an illumination parameter (P), by having the pulse energy of one of the illumination pulses aperiodically changing an illumination parameter (P), by having the specific time interval comprise at least ten different illumination pulses and/or dark phases, by having the specific time interval comprise at least a thousand different illumination pulses or dark phases, by having between ten and sixty changes in one of the illumination pulses per second within the specific time interval, by having between twenty and thirty changes in one of the illumination pulses per second within the specific time interval, by having a change between an illumination phase and a dark phase formed as a temporally periodic change, by having a number of luminous elements, by having a number of shining luminous elements aperiodically changing an illumination parameter, by having at least two luminous elements form a luminous element group with identical luminous parameters (P), by having luminous elements designed as light-emitting diodes, by having luminous elements designed as multicolor light-emitting diodes, by having a technical device designed with the foregoing with a control unit for separately controlling the illumination parameter(s) (P) and/or the dark parameter(s) of individual luminous elements and/or individual luminous element groups and by having a vehicle light warning system with a control unit that has at least one random generator for the quasi-random aperiodic changing of an illumination parameter (P) and/or the dark parameter of individual luminous elements and/or individual luminous element groups.

Consequently, an inventive warning light is distinguished by the fact that an aperiodic change in at least one or more of the illumination parameters is provided in the time interval, in particular the brightness and/or illumination duration and/or frequency and/or color and/or direction of emission or the like.

Owing to the inventive aperiodic change in the illumination parameter, the operator is able to achieve a particular perception and/or acute attentiveness. It is possible here, as well, to talk of a so-called "psycho" light, since the perception and/or the attentiveness of the operator are influenced directly in the brain and are substantially enhanced by comparison with the prior art. Specifically, it has been shown that the previous flashing lights and/or blinking lights etc. are "gradually suppressed" in the brain by the appropriate operator in course of time, that is to say in the course of the operating period of the technical device, for example over a lengthy display phase or weeks or months, the result being that perception is weakened in the course of time. By way of example, this is exceptionally disadvantageous regarding the display of particular critical operating states of appropriate technical devices exhibiting irrelevant potential of risk, for example for humans and/or machine.

In accordance with the invention, in the case of which an aperiodic change in the illumination parameter is provided in the time interval during the display of the specific operating state, no habituation effect takes place for the operator, and so the perception on the one hand is particularly sharp and, on the other hand, is not diminished for the operator even over a lengthy time such as, for example, over months. Consequently, in accordance with the invention the operational safety is substantially increased by comparison with the prior art. First trials with test persons have shown that according to the invention even a "quantum jump" in perception can be realized by the appropriate person.

The aperiodically changing illumination parameter can, for example, be the brightness and/or the illumination duration and/or the frequency per time unit and/or the color and/or direction of emission and/or the increase in the brightness etc. Precisely through the combination of a number of aperiodically changing illumination parameters in the time interval and/or from illumination pulse to illumination pulse leads to a particularly high level of perception and to a reduction in, or, complete avoidance of the risk of habituation of relevant operators. For example, its is possible during the sequence of illumination pulses not only for the brightness to change from illumination pulse to illumination pulse, but also for the length of the illumination pulses and/or the color of the emitted light or illumination pulse to be changed.

In accordance with the invention, a number of appropriately aperiodically varied illumination pulses can be provided one after another. In a particular development of the invention, at least two illumination pulses are separated by a dark phase having at least one dark parameter, such as the duration or the like, for example, which preferably changes aperiodically in the time interval. This means that a pulse with a luminous element switched off or with very low or minimum brightness is provided between the two illumination pulses. It is also correspondingly possible to arrange a number of dark phases, that is to say illumination pulses of low brightness, one after another. This also corresponds to a change in the length of dark phase, and this likewise constitutes an illumination parameter or dark parameter in accordance with the invention.

It is possible, at least in theory, to assume that an illumination pulse has an essentially rectangular profile. However, it is assumed in practice that an illumination pulse has a very steep, continuous rise up to a maximum value, after which it drops again continuously. In accordance with the invention, such illumination pulses can overlap such that temporally lining up similarly bright illumination pulses, for example, very easily lengthens the illumination duration of the luminous element.

Alternatively, or in combination therewith, it is also possible to lengthen the illumination duration visually perceived by the operator by stretching or flattening out the gradient or rise in the illumination pulse or brightness, and/or the duration of the maximum brightness. This can also be realized for the drop in the illumination pulse or the brightness.

For example, an illumination pulse is formed in the manner of a bell curve or Gaussian distribution or the like, that is say the brightness changes substantially in accordance with a bell/Gaussian function, the maximum value being, for example, a prescribed brightness and, at the same time, illumination parameter in the meaning of the invention. It is also possible thereby for the gradient of the rising and/or the falling edge respectively to be an illumination parameter in the meaning of the invention.

In the event of a uniform rising and falling edge, the illumination pulse is formed as a symmetrical illumination pulse. It is also possible as an alternative hereto for an asymmetric illumination pulse to be formed, the rising edge and the falling edge having different gradients or being implemented with different lengths.

Accordingly, it is also possible in accordance with the invention to form the illumination pulse as the aperiodically changing illumination parameter. The operator can thereby certainly perceive an illumination pulse as a gradually brightening illumination pulse which then, for example, ends abruptly or clears over abruptly into a dark phase. In accordance with the invention, such differences likewise lead to a higher level of perception by the appropriate operator.

In a preferred embodiment of the invention, the pulse energy of the illumination pulse is the aperiodically changing illumination parameter. The pulse energy is essentially analogous to the surface under the illumination pulse curve. For example, a very short but high or bright illumination pulse can be generated, and this corresponds approximately to the illumination pulse of so-called flashing light. On the other hand, an illumination pulse can exhibit a comparatively long illumination duration, a maximum brightness by comparison with a light flash being smaller than a multiple, for example having only 10% of the brightness of a so-called light flash.

The time interval advantageously comprises ten different illumination pulses and/or dark phases. It has been shown that such a comparatively small number of different illumination pulses and/or dark phases per time interval leads to a sudden improvement in the perception by a human or the operator.

In a preferred variant of the invention, the time interval comprises at least a thousand or ten thousand or one hundred thousand or over 1 million or more different illumination pulses and/or dark phases. It has been shown in practice that the risk of the habituation to changing illumination parameters is reduced in accordance with the invention with an increasing number of different illumination pulses and/or dark phases. It is currently already technically possible with an entirely coverable outlay to generate several thousand or million different illumination pulses and/or dark phases within a specific time interval during the display of the specific operating state.

The higher the number of different illumination pulses and/or dark phases in the time interval, the longer, in general, becomes this time interval during the warning phase of the specific operating state. Consequently, it is, where appropriate, possible even for a relatively long display of the specific operating state for no single illumination pulse or no single dark phase to be identical, and/or for no repetition of a sequence of illumination pulses to need to be implemented within the time interval.

On the other hand, in accordance with the invention it is perfectly possible after a comparatively long time, for example half a minute or a whole minute, for a first time interval to end and be followed by a second time interval which is essentially identical to the first time interval, etc.

Between ten and sixty changes in the illumination pulse can advantageously be provided per second, at least within the time interval, between twenty and thirty changes in the illumination pulse being provided per second, in particular. It has been shown that a human or the operator perceives so many changes per second with particular attentiveness, or that the attentiveness of the operator is substantially raised. So many changes per second are also known colloquially as so-called "flickering", which is partly felt to be negative, the effect being, inter alia, a substantially raised perception or attentiveness on the part of the operator.

In a particular development of the invention, the change between an illumination pulse and a dark phase is formed as a temporally periodic change. This is advantageous precisely in the case of the previously mentioned (flickering) variant of the invention in the case of which between ten and sixty, preferably between twenty and thirty changes are provided in the illumination pulse per second. In the case of so many changes per second, the dark phases are precisely still perceived by a human or the operator and are felt to be burdensome or negative. Correspondingly, it is also possible here to provide a periodic alternation between illumination pulse and dark phase without the need to fear habituation or impairment of the perception. Correspondingly, periodic alternations between light and dark phases that are, in particular, laid over an aperiodic change in accordance with the invention, can be implemented comparatively easily in terms of design and of control.

A number of luminous elements are provided in one advantageous embodiment of the invention. The provision of a number or the luminous elements further intensifies the effect or the action of the inventive display of the specific operating state. Moreover, additional functionalities can be implemented when use is made of a number of luminous elements. For example, the number of shining luminous elements can also be used as further aperiodically changing illumination parameters. Correspondingly, the perception of the warning light by the operator is further improved by means of a number of luminous elements.

In one advantageous variant of the invention, at least two, in particular three, four etc. luminous elements form a luminous element group with identical illumination parameters. The outlay on control is thereby reduced, since according to the invention the illumination parameter need be changed only for each second or third etc. luminous element. Again, a luminous element group can have another selection of luminous elements per illumination pulse.

The luminous elements of a luminous element group are advantageously arranged in such a way that directions of emission are different. For example, three luminous elements are arranged at an angle of 120° to one another on the circumference of a, for example, cylindrical replaceable module of a so-called signaling column or the like. As a result, in general only a single light-emitting diode or a single luminous element is perceived by an operator or from a fixed viewing angle to the warning light.

The luminous element(s) are/is preferably designed as light-emitting diode. By comparison with incandescent bulbs etc., the light-emitting diodes have particularly short turn-on and turn-off times, and so a signal image or the emitted light or the illumination pulse can be varied with particular advantage in accordance with the invention. For example, the light-emitting diodes can implement particularly abrupt alternations between bright and dark and/or between red and blue etc. Light-emitting diodes can correspondingly be used to generate particular striking effects of perception.

The emitted light of the luminous element is advantageously red, something which is perceived in general as an optical display of particularly critical operating states. It is possible thereby to use both red LEDs, or luminous elements which emit red light. However, it is also possible, for example, to provide luminous elements emitting white light or light-emitting diodes which have an appropriately colored, in particular red spherical cap or the like.

In a preferred variant of the invention, the luminous element(s) is/are designed as multicolor light-emitting diodes. When use is made of multicolor light-emitting diodes such as, for example, so-called RGB-LEDs or the like, it is also possible in a particularly advantageous way to design the color as the aperiodically changing illumination parameter. For example, a white illumination pulse can then be generated after a red illumination pulse, and a blue illumination pulse can subsequently be generated such that the perception via the operator is correspondingly enhanced. When use is made of a number of luminous elements or LEDs, it is therefore simultaneously possible to provide and/or emit different colors, for example per LED and/or per a number of LEDs arranged additionally, and/or per luminous element group.

At least one control unit is advantageously provided for separately controlling the illumination parameter(s) and/or the dark parameter of individual luminous elements and/or of individual luminous element groups. Such an advantageous control unit can be used, for example, to drive and operate each individual light-emitting diode or luminous element independently of the others, and/or the individual luminous element groups can be driven or operated independently of other luminous element groups. A particularly effectively perceived luminous pattern can thereby be implemented.

The control unit preferably has at least one random generator for the quasi-random aperiodic changing of the illumination parameter(s) and/or of the dark parameter of individual luminous elements and/or of individual luminous element groups. It has been shown that using a random generator or a random (quasi-random) change in accordance with the invention leads to a particularly high level of perception by the operator. Since random generators currently in use are unable to generate genuine randomness in a normal case, one speaks here of a so-called quasi-randomness. The quasi-random changes are frequently based on mathematical methods which are generally perceived as random by humans. Use can be made here of a coupling to a processor time, a mathematical series expansion etc. Both already known and future calculation methods can be used in accordance with the invention.

As an alternative to the random generator arranged in the warning light, it is also possible in accordance with the invention to implement quasi-randomly aperiodically changed illumination parameters/dark parameters by, for example, providing values which are stored in the control unit and are arranged in a quasi-random or random fashion in such a way (in tabular form) that upon processing (of the corresponding table) said values generate a random or quasi-random display pattern or illumination pattern of the luminous element in accordance with the invention. During generation or storage, it is possible here to make use of a random generator in the above-named sense in order to implement the random or quasi-random (tabular) arrangement in an appropriate memory of the control unit.

When using a so-called processor or the like in the warning light, for example per clock pulse of the processor, it is possible in principle to change an illumination parameter/dark parameter such that the illumination pulse changes per clock pulse of the processor. However, with present day processors the clock time is already so short that a human will perceive this only conditionally. It is advantageously possible to define a standardized illumination pulse duration of the warning light that comprises a number of individual clock pulses of the processor. During this standardized illumination pulse duration, the processor, for example may vary a number of dark/illumination parameter values that then become valid for the next illumination pulse and/or dark phase, that is to say determine the illumination characteristic of the next illumination pulse. By means of the number of clock pulses of the processor per illumination pulse, it is possible, for example, also to vary the duration thereof. It becomes clear that virtually unlimited possibilities of implementing the invention exist precisely when use is made of a processor.

In one variant of the invention, a prescribed or minimum difference can be provided between the values of the illumination parameter to be changed, which relates to two illumination pulses and/or the dark parameter, in order to take account advantageously of human perceptivity. For example, the brightness and/or the duration of the illumination pulse and/or the dark phase could be changed by at least 20% etc. A corresponding difference may be defined or set for example by means of the control unit.

BRIEF DESCRIPTION OF THE SEVERAL VIEWS OF THE DRAWINGS)

An exemplary embodiment of the invention is illustrated in the drawing and will be explained in more detail with the aid of the figures below, in which.

DETAILED DESCRIPTION OF THE INVENTION INCLUDING BEST MODE

Figure 1:
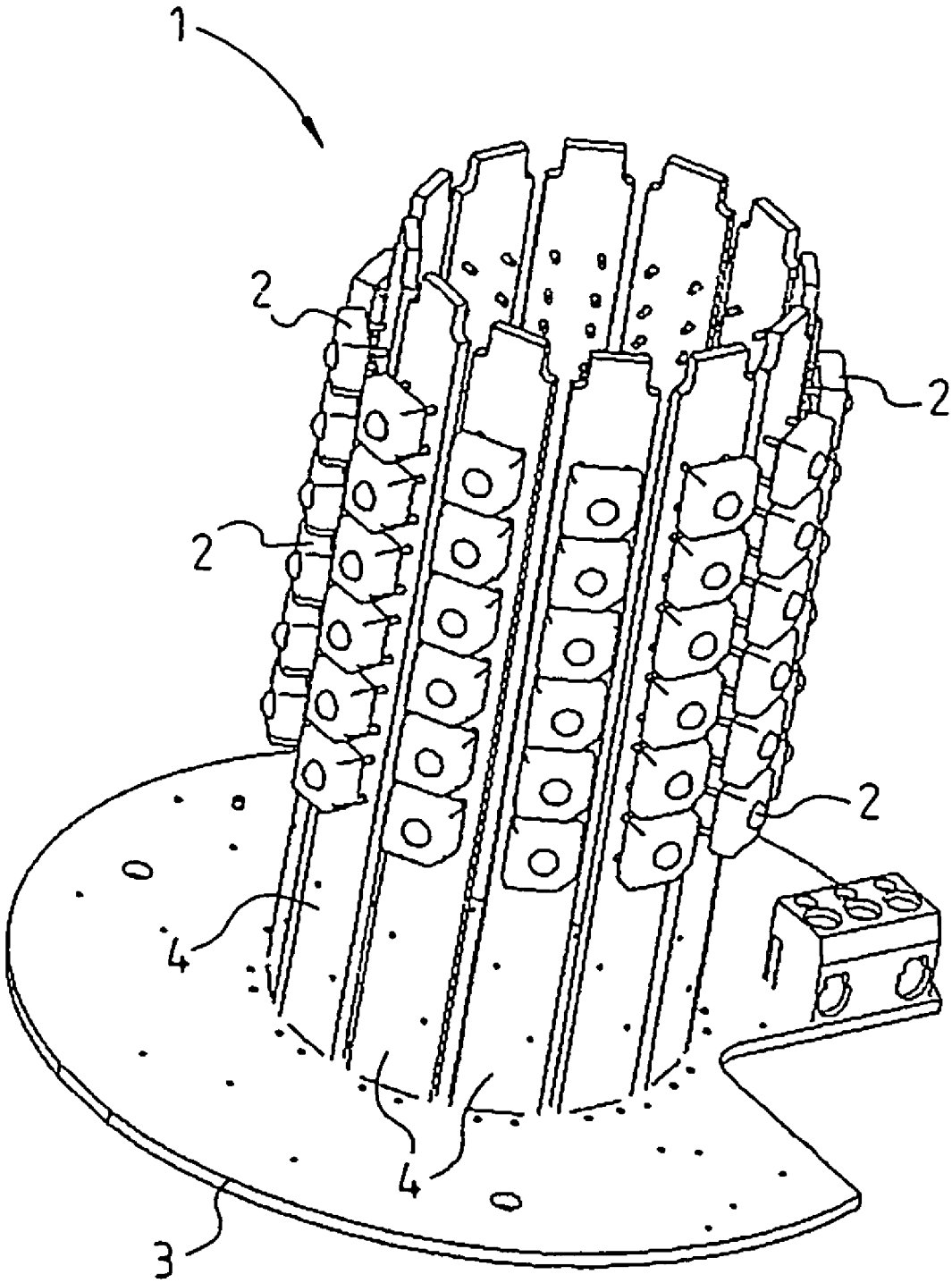
FIG. 1 shows a schematic perspective illustration of an inventive illumination unit with numerous LEDs.

FIG. 1 illustrates an illumination unit 1 which has numerous LEDs 2. The LEDs 2 are arranged on a holder 3 which can, for example, be integrated in an individual light and/or in a so-called replaceable module of so-called signaling columns. The holder 3 or illumination unit 1 can be integrated here in a spherical light cap. The holder 3 comprises a number of webs 4 which are arranged cylindrically, each web 4 comprising a number of LEDs 2. The result of this is that the illumination unit 1 can emit appropriate warning light all around.

Without further illustration, the illumination unit 1 advantageously comprises a control unit which, for example, has a random generator and/or a memory unit. In accordance with the invention, each LED 2 can emit a sequence of illumination pulses, an aperiodic change of at least one parameter P being provided in a specific time interval for a specific operating state.

Figure 2:
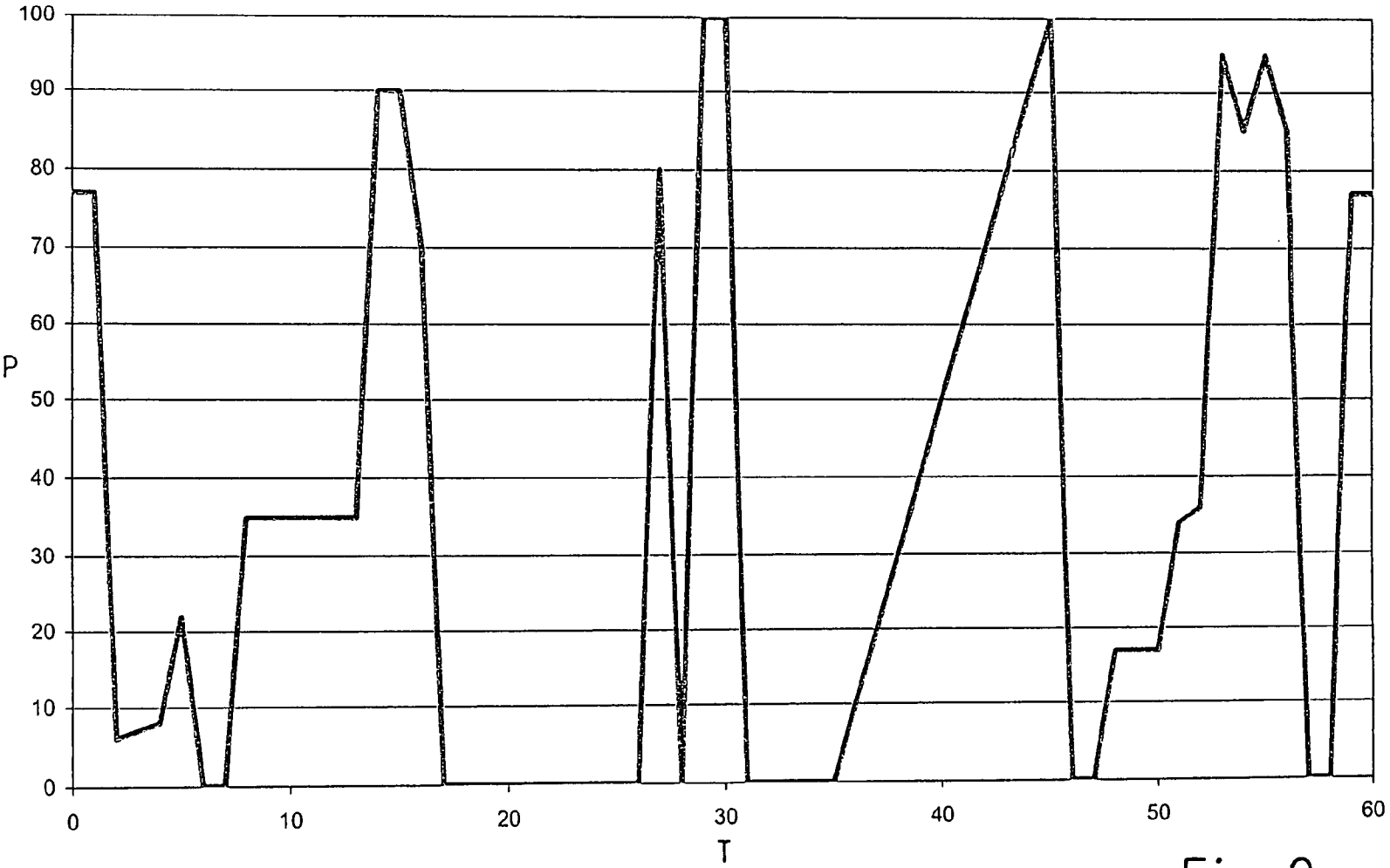
FIG. 2 shows a schematic illustration of a profile of an individual illumination parameter during a time interval.

FIG. 2 shows by way of example the aperiodic change of the illumination parameter P over a time T. For example, the unit of the illumination parameter P is represented in percent. The unit of the time T can be given, for example, in seconds or milliseconds or parts of a second or the like.

The time interval illustrated in FIG. 2 consequently lasts sixty time units. This time interval can be repeated, for example, during the display or warning phase of the specific operating state such as, for example, magazine of a machine tool empty, or tool damaged etc. Thus, a number of time intervals, such as are illustrated for example in FIG. 2, can be lined up one after another in time until the operator perceives the warning or the display of the operating state and introduces appropriate measures, for example actuates a knob, key or the like, and/or operates the emergency stop of the technical device etc.

The illumination parameter P is the relative luminous intensity in FIG. 2, for example. This means that at the beginning of the time interval the relative luminous intensity or the illumination parameter P is approximately 75% and is unchanged over a number of time units, subsequently falling rapidly to a value of smaller than 10%. Subsequently it rises slightly again over a comparatively long time period and then rises very rapidly over a very short time period or by a very few time units, and then falls again very sharply until the relative luminous intensity is at 0%. This means that the luminous element or the LED 2 is switched off or dark during this phase.

In accordance with the changes, illustrated by way of example in FIG. 2, of the illumination parameter P or the relative luminous intensity, in accordance with the invention, the aperiodically changing brightness is varied over the entire time duration of the time interval by means of the advantageous control unit or appropriately stored values and/or values generated by means of a processor or the like.

In order to change the illumination parameter P or the relative luminous intensity in accordance with FIG. 2, the voltage and/or the electric current at the luminous element or the LED 2 can be varied, for example. The control unit or the processor generates by way of example an illumination pulse per luminous element or LED which is distinguished by a specific illumination characteristic with defined illumination parameters P. As is implemented at the beginning of the profile illustrated in FIG. 2, by way of example, lining up a number of unchanged illumination pulses varies the duration of a correspondingly implemented overall illumination pulse. For example, an overall illumination pulse runs from a time unit 35 up to approximately 47. The last named overall illumination pulse exhibits, for example, a flatter rise of the illumination pulse up to the maximum value, that is to say 100% relative luminous intensity, and a very abrupt fall in brightness down to 0% brightness, that is to say down to a dark phase. Following this dark phase is an overall pulse which is composed, if appropriate, of numerous individual illumination pulses which exhibits a step-like or variable shape by comparison with the above-named overall pulse.

FIG. 2 illustrates, in particular, the formation of illumination phases of different length, dark phases, different shapes of illumination pulses and/or overall illumination pulses of different luminous intensities and/or brightnesses and of different illumination pulse energies per illumination pulse.

Of course, the profile, illustrated in FIG. 2, of the relative luminous intensity, or the profile of the illumination parameter P is an exemplary profile. If, in accordance with the invention, in part up to thousands or even several millions of different illumination pulses and/or dark phases are, for example, stored in a memory unit of the control unit and appropriately processed, an innumerable variety of time intervals results in accordance with the invention. Given such a high number of different illumination pulses and/or dark phase, an operator or human will no longer be able to define any regularity, and so it is possible to talk of a random or arbitrary change in the illumination pulse or the emitted light.

With appropriate aperiodically changing illumination parameters P, there is a decisive increase in the perception of appropriate operators by comparison with the prior art such as for example, periodically flashing lights, all round light or the like.

In principle, given a change in the illumination parameter P or the relative luminous intensity in accordance with FIG. 2, a human or the operator will perceive a change more readily in the form of an envelope laid around the illustrated curve or the like, but this has no negative consequences with reference to the increased recording of the optical display of the operating state, but is taken into account advantageously in accordance with the invention.

Figure 3:
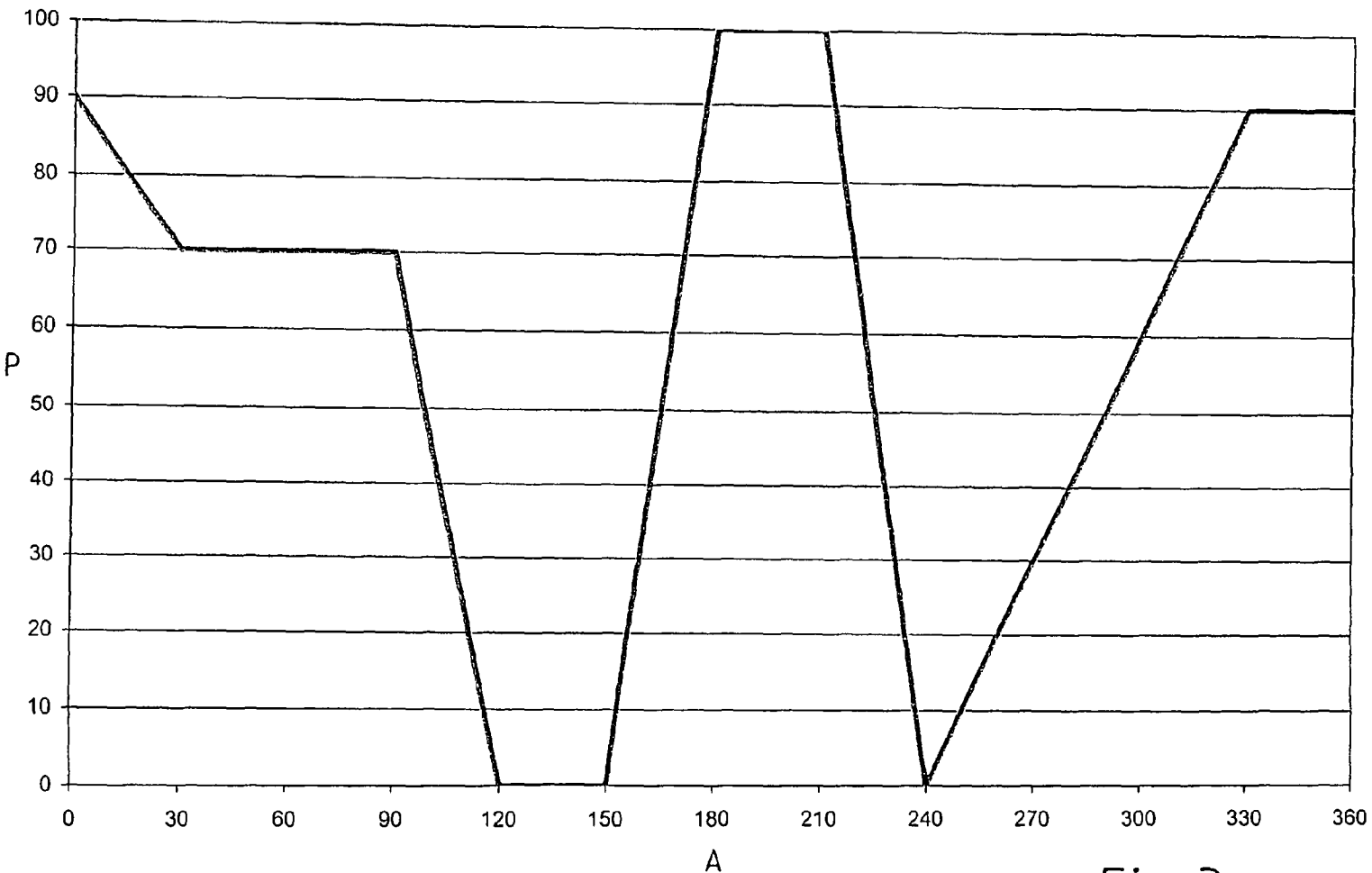
FIG. 3 shows a schematic illustration of an emission profile of the individual illumination parameter of the illumination unit in accordance with FIG. 1 at a specific instant.

Shown schematically and by way of example in FIG. 3, in turn, is the illumination parameter P, in particular the relative luminous intensity in percent plotted against an angle A. The angle A represents the all round direction of emission in angular degrees of the illumination unit 1 in accordance with FIG. 1 at a specific instant or moment. This renders it clear that, for example, the illumination parameter P or the relative luminous intensity in a radial direction changes or is formed irregularly or aperiodically. Individual strips 4 are, for example, wholly or partially dark at the instant in accordance with FIG. 3, and so there is no relative luminous intensity to record in the angular range between 120° and 150°. By contrast, at the same instant the illumination parameter P or the relative luminous intensity is at 100%, for example, between the viewing angles between 180° and 210°, that is to say the corresponding strip 4 is emitting light at maximum brightness.

In accordance with the invention a type of moving or flickering light is generated having the effect that the specific operating state displayed generates the highest level of attentiveness in a human or the operator. A quantum jump is correspondingly implemented in the perception of particularly critical operating states or of the operating state to be displayed, on the part of the operators. It has emerged that such a wavering and flickering of the warning light can be of decisive importance in accordance with the invention, this being so inter alia in workshops with innumerable, different optical light influences.

What is claimed is:

1. In a warning light for optically displaying at least one operating state of a device said warning light having at least one luminous element (2) for emitting a sequence of a number of illumination pulses within a specific time interval during a display of a specific operating state, the illumination characteristic of the illumination pulses being determined by at least one illumination parameter (P) selected from a group of illumination parameters including brightness, illumination duration, frequency, color, or direction of emission wherein the improvement comprises a control unit with a random generator, processor or memory unit providing a random aperiodic change in at least one of the illumination parameters (P) in the specific time interval.

2. The warning light according to claim 1 wherein at least two illumination pulses are separated by a dark phase having at least one dark parameter.

3. The warning light according to claim 1 or 2 wherein an aperiodic change in the dark parameter is provided in the specific time interval.

4. The warning light according to claim 1 or 2 wherein at least two illumination pulses overlap.

5. The warning light according to claim 1 wherein a form of one of the illumination pulses is the random aperiodic changing illumination parameter (P).

6. The warning light according to claim 1 wherein a pulse energy of one of the illumination pulses is the random aperiodic changing illumination parameter (P).

7. The warning light according to claim 1 wherein the specific time interval comprises at least ten different illumination pulses and/or dark phases.

8. The warning light according to claim 1 wherein the specific time interval comprises at least a thousand different illumination pulses and/or dark phases.

9. The warning light according to claim 1 wherein between ten and sixty changes in one of the illumination pulses per second are provided, at least within the specific time interval.

10. The warning light according to claim 9 wherein between twenty and thirty changes in one of the illumination pulses per second are provided, at least within the specific time interval.

11. The warning light according to claim 1 wherein a change between an illumination pulse and a dark phase is a temporally periodic change.

12. The warning light according to claim 1 wherein a number of luminous elements (2) are provided.

13. The warning light according to claim 1 wherein a number of shining luminous elements (2) provides the random aperiodic change of an illumination parameter (P).

14. The warning light according to claim 1 wherein at least two luminous elements (2) form a luminous element group (4) with identical illumination parameters (P).

15. The warning light according to claim 1 wherein the at least one luminous element(s) (2) is a light-emitting diode (2).

16. The warning light according to claim 1 wherein the at least one luminous element(s) (2) is a multicolor light-emitting diode.

17. A technical device having a warning light for optically displaying at least one operating state of said technical device comprising:

(a) at least one luminous element to emit a sequence of illumination pulses in a specific time interval determined by an operating condition of a technical device;

(b) a control unit for controlling an illumination parameter or a dark parameter of said at least one luminous element; and (c) a random generator, memory unit or processor connected to said control unit to provide a quasi random aperiodic change in said illumination parameter or said dark parameter of said at least one luminous element during said specific time interval.

18. A vehicle warning light for optically displaying an operational state of a vehicle comprising:

(a) at least one luminous element to emit a sequence of illumination pulses in a specific time interval determined by an operating condition of a vehicle;

(b) a control unit for controlling an illumination parameter of said at least one luminous element; and (c) at least one random generator, memory unit or processor associated with said control unit for the quasi-random aperiodic changing of the illumination parameter (P) or the dark parameter of said at least one luminous element wherein said random generator, memory unit or processor provides a random aperiodic illumination parameter for said at least one luminous element or a random aperiodic dark parameter of said at least one luminous element at about ten to sixty per second within the specific time interval.

* * * * *